US009546322B2

(12) United States Patent
Gast

(10) Patent No.: US 9,546,322 B2
(45) Date of Patent: Jan. 17, 2017

(54) CLOSED COKE SLURRY SYSTEM AND METHOD FOR GAINING SELLABLE PETROLEUM COKE PIECES OUT OF SOLIDIFIED PETROLEUM COKE IN A COKE DRUM UNIT

(75) Inventor: Ralf Gast, Bruchsal (DE)

(73) Assignee: Tri-Plan AG, Bad Soden (DE)

( * ) Notice: Subject to any disclaimer, the term of this patent is extended or adjusted under 35 U.S.C. 154(b) by 557 days.

(21) Appl. No.: 14/115,926

(22) PCT Filed: Jul. 14, 2011

(86) PCT No.: PCT/EP2011/062061

§ 371 (c)(1),
(2), (4) Date: Nov. 8, 2013

(87) PCT Pub. No.: WO2012/152340

PCT Pub. Date: Nov. 15, 2012

(65) Prior Publication Data

US 2014/0076707 A1 Mar. 20, 2014

(30) Foreign Application Priority Data

May 11, 2011 (EP) ..... 11165699

(51) Int. Cl.
*C10B 55/00* (2006.01)
*C10B 39/04* (2006.01)
(Continued)

(52) U.S. Cl.
CPC ..... *C10B 39/06* (2013.01); *C10B 33/003* (2013.01); *C10B 39/04* (2013.01); *C10B 55/00* (2013.01)

(58) Field of Classification Search
CPC ..... C10B 39/04; C10B 39/06; C10B 55/00; C10B 33/003; C10G 9/005; C10G 9/18
(Continued)

(56) References Cited

PUBLICATIONS

Feintuch, Howard M. et al., FW Delayed-Coking Process; Handbook of Petroleum Refining Processes, pp. 12.61-12.70 (Copyright 2004).

(Continued)

*Primary Examiner* — Jill Warden
*Assistant Examiner* — Joye L Woodard
(74) *Attorney, Agent, or Firm* — Wiggin and Dana LLP; Gregory S. Rosenblatt; Jonathan D. Hall

(57) ABSTRACT

A closed system for gaining sellable petroleum coke pieces out of solidified petroleum coke in a coke drum unit, comprises a coke drum unit containing solidified petroleum coke; a coke crushing unit for crushing petroleum coke into sellable petroleum coke pieces; a closed slurry pipe leading petroleum coke slurry to a closed slurry pit; a dewatering bin unit for receiving petroleum coke slurry from the slurry pit, for collecting the sellable petroleum coke pieces and for leading filtered water and petroleum coke fines out of it; a closed drain water pit, separate from the slurry pit, for receiving the filtered water and the petroleum coke fines from the dewatering bin unit; a water settling tank receiving the filtered water and the petroleum coke from the drain water pit and for separating the petroleum coke fines from the water such that the petroleum coke fines collect in the bottom part of the water settling tank, and for leading the petroleum coke fines into the slurry pit where they mix with the petroleum coke slurry; a clean water tank for receiving the purified water from the upper part of the water settling tank; and a removal unit for removing the sellable petroleum coke pieces from the dewatering bin unit.

22 Claims, 3 Drawing Sheets

(51) Int. Cl.
*C10B 39/06* (2006.01)
*C10B 33/00* (2006.01)

(58) Field of Classification Search
USPC 201/2, 3; 202/241; 208/131, 48 Q; 196/107, 122; 210/767, 800, 806
See application file for complete search history.

(56) References Cited

PUBLICATIONS

Debiase, Robert et al., Delayed-Coking Process Update; ACS Symposium Series, 1986 ACS, 1986; pp. 155-171.
PCT/EP2011/062061—International Preliminary Report on Patentability, Mailed Sep. 24, 2013.
Feintuch, Howard M., "FW Delayed-Coking Process," Handbook of Petroleum Refining Processes, Third Edition, McGraw-Hill, pp. 12.61-12.70, (Copyright 2004).

QUENCHING CYCLE

DECOKING AND DEWATERING CYCLE

DEWATERING CYCLE

CLOSED COKE SLURRY SYSTEM AND METHOD FOR GAINING SELLABLE PETROLEUM COKE PIECES OUT OF SOLIDIFIED PETROLEUM COKE IN A COKE DRUM UNIT

CROSS-REFERENCE TO RELATED PATENT APPLICATIONS

This patent application is a U.S. National Phase of PCT/EP2011/062061 titled "Closed Coke Slurry System and Method for Gaining Sellable Petroleum Coke Pieces Out of Solidified Petroleum Coke in a Coke Drum Unit" that was filed on Jul. 14, 2011 and claims priority to EP 11165699.7 that was filed on May 11, 2011. The subject matter of PCT/EP2011/062061 is incorporated by reference in its entirety herein.

BACKGROUND

Closed coke slurry system and method for gaining sellable petroleum coke pieces out of solidified petroleum coke in a coke drum unit The invention relates to a closed system and method for gaining sellable petroleum coke pieces out of solidified petroleum coke in a coke drum unit.

Petroleum coke is produced through a thermal cracking process as part of the hydrocarbon processing industry. Oily residue streams are heated up in a furnace coil and routed into a coke drum. The furnace effluent composition bonding breaks into light hydrocarbons and ultimately in solidified petrol coke. The light hydrocarbons will be sent into refinery downstream units for further processing.

The produced petroleum coke fills the coke drum from bottom to top continuously. As soon as one coke drum has been filled up, the oily residue will be switched to another empty coke drum.

In order to remove the solidified petroleum coke from the full coke drums, traditionally the so-called pit/pad-system is applied. The pit/pad-system comprises a large open concrete floor in front of the coke drums. The coke is cut out of the coke drum at high temperatures by means of high pressure cutting water, and the coke chunks together with the cutting water is gushed onto a pit floor. Entrainment water flows sideways through a labyrinth, and drain water is pumped into settling and subsequent clean water tanks for recycling. The coke chunks pile up and rest in the pit/pad, until they are taken out of it and fed to a crusher located nearby by means of manually operated overhead cranes or manually operated front loaders. The broken coke pieces are then conveyed to the loading facilities.

A coker with such pit/pad system comprises huge steam clouds engulfing the coker unit, that can be seen from great distances.

Such pit/pad system has a high impact to the atmosphere, since a large amount of steam polluted with coke fines discharges into the atmosphere. The steam contains hydrocarbons, coke dust and aerosols. This causes health problems to the operational and maintenance personnel, especially if they have been exposed to such pit/pad system over a long time. Further, such pit/pad system requires a substantial amount of manual work, especially for operating the overhead cranes or the front loaders, for coke crushing and sludge handling.

SUMMARY

It is therefore an object of the invention to provide an atmospheral-friendly system and a method for gaining sellable petroleum coke pieces out of solidified petroleum coke in a coke drum unit that can be run automatically and reduces the operational costs.

This object is solved by the subject matter of the independent claims. Further embodiments are defined in the subclaims.

A closed system for gaining sellable petroleum coke pieces out of solidified petroleum coke in a coke drum unit according to the invention comprises a coke drum unit containing solidified petroleum coke; a coke crushing unit for crushing petroleum coke into sellable petroleum coke pieces; a closed slurry pipe leading petroleum coke slurry to a closed slurry pit; a dewatering bin unit for receiving petroleum coke slurry from the slurry pit, for collecting the sellable petroleum coke pieces and for leading filtered water and petroleum coke fines out of it; a closed drain water pit, separate from the slurry pit, for receiving the filtered water and the petroleum coke fines from the dewatering bin unit; a water settling tank receiving the filtered water and the petroleum coke from the drain water pit and for separating the petroleum coke fines from the water such that the petroleum coke fines collect in the bottom part of the water settling tank, and for leading the petroleum coke fines into the slurry pit where they mix with the petroleum coke slurry; a clean water tank for receiving the purified water from the upper part of the water settling tank; and a removal unit for removing the sellable petroleum coke pieces from the dewatering bin unit.

A method for gaining sellable petroleum coke pieces out of solidified petroleum coke in a coke drum unit according to the invention comprises a quenching cycle in which the coke drum unit is flooded by means of a quench water line leading from a clean water tank via the coke drum unit to a slurry pit, thereby hardening and cooling the solidified petroleum coke; a drum decoking and dewatering cycle in which petroleum coke chunks coming from the coke drum are crushed into sellable petroleum coke pieces by means of a coke crushing unit, the sellable petroleum coke pieces are led with the aid of transport water thus forming a petroleum coke slurry to a closed slurry pit through a closed slurry pipe, the petroleum coke slurry is pumped from the slurry pit to the dewatering bin unit, the sellable petroleum coke pieces collect in the dewatering bin unit and filtered water and petroleum coke fines are led to a drain water pit, separate from the slurry pit, the filtered water and the petroleum coke fines are pumped from the drain water pit to a water settling tank where the petroleum coke fines separate from the water and collect in the bottom part thereof, and the petroleum coke fines are led into the slurry pit where they mix with the petroleum coke slurry; a dewatering cycle in which filtered water and petroleum coke fines are led from the dewatering bin unit to the drain water pit, the filtered water and the petroleum coke fines are pumped from the drain water pit to the water settling tank where the petroleum coke fines separate from the water and collect in the bottom part thereof, and the petroleum coke fines are led into the slurry pit, until a predetermined dewatering level within the dewatering bin unit is reached; and a fourth removing step, in which the sellable petroleum coke pieces are taken out of the dewatering bin unit.

For the sake of brevity, a system for gaining sellable petroleum coke pieces out of solidified petroleum coke in a coke drum unit can also be named coker unit or coker system.

Due to a quite long residence time, typically 8 to 12 hrs, for the residue in lieu with process heat, typically 490 to 510 deg. C., at relatively low pressure, the process/method for gaining sellable petroleum coke pieces out of solidified petroleum coke in a coke drum unit can also be referred to as delayed coking.

Prior to the method for gaining sellable petroleum coke pieces out of solidified petroleum coke in a coke drum unit according to the invention is carried out, oily residue streams are heated up in a furnace coil and then routed into a coke drum. A row of swing coke drums, especially 2 or 4 drums, can be provided working in batch operating mode. The full coke drum, after it has been filled up with solidified petroleum coke, will be isolated from the furnace coil, and the method for gaining sellable petroleum coke pieces out of solidified petroleum coke in a coke drum unit according to the invention can be started.

The system and method for gaining sellable petroleum coke pieces out of solidified petroleum coke in a coke drum unit according to the invention reduce the discharge of steam polluted with coke fines to the atmosphere, since the system is closed and gastight, and no steam can get into the atmosphere in uncontrolled manner as has been the case with the conventional pad/pit-system. Besides the substantial reduction of the impact on the atmosphere, this also eliminates the operating and maintenance personnel exposure to steam, dust, and aerosols, which leads to a high system acceptance and reduces atmospheral issues with local authorities. Thereby a high standard in working place hygiene and workers safety is achieved, especially in terms of visibility and exposure to hot water, steam and dust.

According to one underlying idea of the invention, separate, dedicated slurry and drain water pits are provided. This allows to start immediately with dewatering the petroleum coke slurry during the cutting cycle, rather than to wait until cutting is finished. Water can be pulled out from the dewatering bin as soon as the slurry is transferred. This alone leads to an expected time gain in the order of a couple of hours, especially 3-4 hours in case of a normal-sized system. During the drum decoking and dewatering cycle and during the dewatering cycle, filtered water that continuously runs off from the dewatering bin, that is basically already technically clean or light greyish due to a small amount of coke fines, is collected in the separate drain water pit. From here, the drain water is led into the water settling tank for further settlement of coke fines.

According to a further underlying idea of the invention, the slurry pipe, the slurry pit and the drain water pit are of closed construction which prevents steam polluted with coke fines to discharge into the atmosphere in an uncontrolled manner. Should the temperature levels within the slurry pit and the drain water pit make it necessary to release some vapor from the system, this will be done by means of vents provided at the slurry pit and the drain water pit.

According to a further underlying idea of the invention, the petroleum coke sludge comprising accumulated coke fines is purged into the slurry pit and mixes with the slurry stream coming through the slurry pipe from the coke drum. This sludge is then pumped into the dewatering bin. Therefore the relatively small sludge stream mixes and therefore well disperses with coarse coke pieces from the coke drum and the crusher to the effect that the coke fines are clamped on the surface of coke pieces or are trapped in the porous lumps of the coke pieces and remain there. This results in a minimized and remarkably small amount of sludge, an improved distribution of sludge, an effective sludge management and handling, a high dewatering effect which is not deteriorated by uneven distribution of sludge, and a significantly improved water quality.

According to a further underlying idea of the invention, the steam that is generated is minimized by introducing transport water into the coke bed and/or the slurry pipe.

According to a further underlying idea of the invention, the coke crushing unit grinds the coke chunks down to a size which enables pumping of the petroleum coke slurry. As this size corresponds well with commercial demand no further additional size reduction is needed afterwards, which results in a high-efficient operation.

Further, pure mechanical sequences like operating overhead cranes or front loaders are avoided, and the method for gaining sellable petroleum coke pieces out of solidified petroleum coke in a coke drum unit is a basically continuous, fully controllable and automatic process similar to a typical process well known from hydrocarbon processing. In normal operation, no manual active interaction from operating personnel is required. This reduces the manpower needed to operate and maintain such system and, respectively, to carry out such method, which directly leads to cost savings. The system reliability is high and exceeds the current state of the art standard. Furthermore, the cycles and steps of the method according to the invention are fully remote controllable.

Moreover, both a substantial cycle time reduction and an increase of throughput are attained.

Except for vapor losses that can occur and that can be replaced with makeup water from external sources, all slurry, sludge and water streams are optimized and self sustained.

The petroleum coke slurry runs through the slurry pipe, which is a closed pipe, into the slurry pit, which is a tight concrete slurry pit, by gravity.

During the drum decoking and dewatering cycle, immediately after slurry pumping into the dewatering bin has started, the dewatering effect begins. That means that the dewatering effect takes already place while drum decoking is still in progress and particularly during the drum decoking and dewatering cycle and during the dewatering cycle. Once the degree of dewatering is sufficient the sellable petroleum coke pieces can be taken out of the dewatering bin. In particular, the sellable petroleum coke pieces can be transported to loading facilities by means of a conveyor.

Clean water drawn off from the clean water tank can directly be used as high pressure cutting water without the need for another settling tank.

The system and method for gaining sellable petroleum coke pieces out of solidified petroleum coke in a coke drum unit according to the invention can be operated in batch operation, that means that once a coke drum is filled up it is separated from the furnace coil and the method according to the invention is carried out. The useable time frame is limited by the time available for filling the coke drum with hot residue, cooling and emptying/cutting the coke bed and the time to dewater the sellable coke pieces in the dewatering bin up to transport.

In the past, improvements in the batch operational steps of delayed coker units, especially coke cutting, slurry transport, dewatering time, to perform faster, yet safe and reliable handling of the mechanical equipment were difficult to accomplish. And if so, an unavoidable high degree of manual operation remained.

This stonewall problem has now been solved by the system and method for gaining sellable petroleum coke pieces out of solidified petroleum coke in a coke drum unit according to the invention. The reliability of the mechanical equipment has been improved, and formerly manually operational steps have been converted into a continuous, controllable typical day-to-day hydrocarbon industry working process.

Existing coker units, e.g. of the pit/pad type can be retrofitted, converted or modernized to form a closed system for gaining sellable petroleum coke pieces out of solidified petroleum coke in a coke drum unit according to the invention.

According to a first embodiment of the invention, a quench water line is provided leading from the clean water tank via the coke drum unit to the slurry pit, for flooding the coke drum unit, thereby hardening and cooling the solidified petroleum coke effectively.

According to a further embodiment of the invention, a slurry pit cooling line is provided connecting the clean water tank to the slurry pit, for cooling the slurry pit. By such feature the steam generation in the slurry pit can effectively be minimized.

According to a further embodiment of the invention, a line is provided connecting the slurry pit to the dewatering bin unit for pumping petroleum coke slurry to the dewatering bin unit.

According to a further embodiment of the invention, a line is provided connecting the dewatering bin unit to the drain water pit for leading the filtered water and the petroleum coke fines to the drain water pit.

According to a further embodiment of the invention, a line is provided connecting the drain water pit to the water settling tank for pumping the filtered water and the petroleum coke fines to the water settling tank.

According to a further embodiment of the invention, a coke cutting unit is provided for cutting the solidified petroleum coke out of the coke drum unit. The coke cutting unit can be of conventional type. It can be a water drilling/cutting tool configured to drill a vertical channel into the solidified petroleum coke within the coke drum unit and to cut slices of the solidified petroleum coke within the coke drum unit, which allows for effective and fast cutting of the solidified coke out of the coke drum. The water drilling/cutting tool can be operated with water from the clean water tank, so no external water is needed. The water drilling/cutting tool can be configured to be lowered into the coke drum via the upper drum head to ream out the coke drum with a high pressure water jet. In particular, the water drilling/cutting tool can be configured to drill a vertical channel into the coke bed within the coke drum first, followed by the cutting operation whereby a horizontal jet stream cuts slices of coke out of the coke bed, which are flushed down to the coke crushers/the coke crushing unit.

According to a further embodiment of the invention, the coke crushing unit is formed as a respective coke crusher mounted under a respective coke drum of the coke drum unit. By such feature the coke chunks falling out of the coke drum automatically get to the crusher where they are grinded.

According to a further embodiment of the invention, the coke crushers comprise crush rolls with teeth patterns, in order to grind the coke chunks falling out of the coke drum to coke pieces of a predetermined maximum size that fits to the commercial demand. No further size reduction is needed.

According to a further embodiment of the invention, the coke crushers each comprise two crusher rolls, being driven separately, and reversible drives. The coke crushers have a designed capacity suitable to handle instantly 200% of peak cutting load, and they have a roll diameter and teeth pattern with pull-in feature for crushing maximum lump size.

According to a further embodiment of the invention, the coke crushers are for grinding the coke chunks, cut from the solidified petroleum coke by the coke cutting unit, to sellable petroleum coke pieces of a size enabling pumping of the petroleum coke slurry. No further size reduction is needed.

According to a further embodiment of the invention, for each coke drum a dedicated crusher with a metal transition piece, especially a telescopic chute, with remote hydraulic devices is provided to connect the respective coke crusher to the respective coke drum. The metal transition piece will be pulled up remotely and can automatically connect the full coke drum with a coke crusher. This connection will be performed only during coke cutting operation.

According to a further embodiment of the invention, a transport water line is provided leading from the clean water tank to the closed slurry pipe for supporting flushing of the petroleum coke slurry to the slurry pit. By such transport water line the coke pieces are led to the slurry pit in a fast, reliable and efficient manner.

According to a further embodiment of the invention, the line leading from the slurry pit to the dewatering bin unit is provided with a pump for pumping the petroleum coke slurry to the dewatering bin unit. This pump is a cavitation, corrosion and wear resistant pump. This pump elevates the petroleum coke slurry into the corresponding dewatering bin. It has to be of such configuration that it allows for pumping of the petroleum coke slurry comprising the sellable coke pieces into the dewatering bin.

According to a further embodiment of the invention, the dewatering bins of the dewatering bin unit comprise an upper cylindrical section and a lower conical section, the upper cylindrical section and the upper part of the lower conical section being provided with filtering channels, especially inner screens or inner vertical screens, and/or the lower part of the lower conical section being provided with a perforation pattern, for removing accumulated water from the dewatering bins. By this embodiment, a significantly improved and high-effective removal of accumulated water from the dewatering bin, and in particular from the lower area of the dewatering bin, are attained. Those petroleum coke pieces that have a size or a diameter being bigger than the openings in the filter elements remain in the dewatering bins. This is the bigger portion than the petroleum coke pieces that have a size or a diameter being smaller than the openings in the filter elements and passing through the same. Thereby the amount of sludge in the water settling tank is minimized.

According to a further embodiment of the invention, piping is provided connecting the filtering channels and the perforation pattern to the line leading to the drain water pit. This allows for an effective removal of the filtered drain water from the dewatering bin.

According to a further embodiment of the invention, the line leading from the drain water pit to the water settling tank is provided with a pump, especially with a cavitation, corrosion and erosion resistant pump for pumping the water together with the petroleum coke fines to the water settling tank.

According to a further embodiment of the invention, the water settling tank and the clean water tank are connected to one another by a balancing line, preferably being arranged at an upper portion thereof. This provides for an effective way of leading purified clean water from the water settling tank to the clean water tank.

According to a further embodiment of the invention, the removal unit is formed as a conveyer belt positioned below the dewatering bin unit so as to transport the sellable petroleum coke pieces falling out from the dewatering bin unit once the bottom part thereof is opened, to appropriate loading facilities.

According to a further embodiment of the invention, the slurry pit and/or the drain water pit and/or the dewatering bins are provided with vents for discharging vapors to the atmosphere, with the outlets of the vents preferably being situated above operator level. Such vents can be opened and closed individually so as to allow for discharging of vapor only when this is actually needed. By such vents remaining minimum vapors from the pits and the dewatering bins can be released to the atmosphere. By locating the outlets of the vents well above the operator platforms a good visibility can be ensured and exposure of operating personnel to hydrocarbons, dust and aerosols can be avoided.

According to a further embodiment of the invention, the dewatering bin unit is provided with an overflow protection unit, the overflow protection unit being configured as a line attaching at an upper portion of the dewatering bin unit and leading to the slurry pit and/or the water settling tank. The overflow protection unit has no active function in normal operation but serves as a safety device to protect the dewatering bins from overfilling inadvertently.

According to a further embodiment of the invention, the number of coke drums corresponds to the number of dewatering bins. A receiving dewatering bin corresponds to a full coke drum and his dedicated coke crusher.

In the quenching cycle, the coke drum can be repeatedly flooded with water and emptied from this water which hardens and cools the coke in the coke drum. Prior to the quenching cycle steam is introduced into the coke drum unit. After the quenching cycle, the upper and lower coke drum heads can be opened in order to allow for the coke chunks to get out of the coke drum.

According to a further embodiment of the invention, during the drum decoking and dewatering cycle, the water is continuously drained into the drain water pit. A pump transports the water from the drain water pit to the water settling tank. After settling, prior to the next cutting operation the purified water is transferred from the water settling tank to the clean water tank for cutting.

According to a further embodiment of the invention, any small amount of vapors from the slurry pit and the drain water pit are discharged via vents to the atmosphere, preferably above operator level. Thereby a high standard in working place hygiene and workers safety is achieved, especially in terms of visibility and exposure to hot water, steam and dust.

BRIEF DESCRIPTION OF THE DRAWINGS

The invention is further explained below by means of embodiments with reference to the attached Figures.

DETAILED DESCRIPTION

Figure 1:
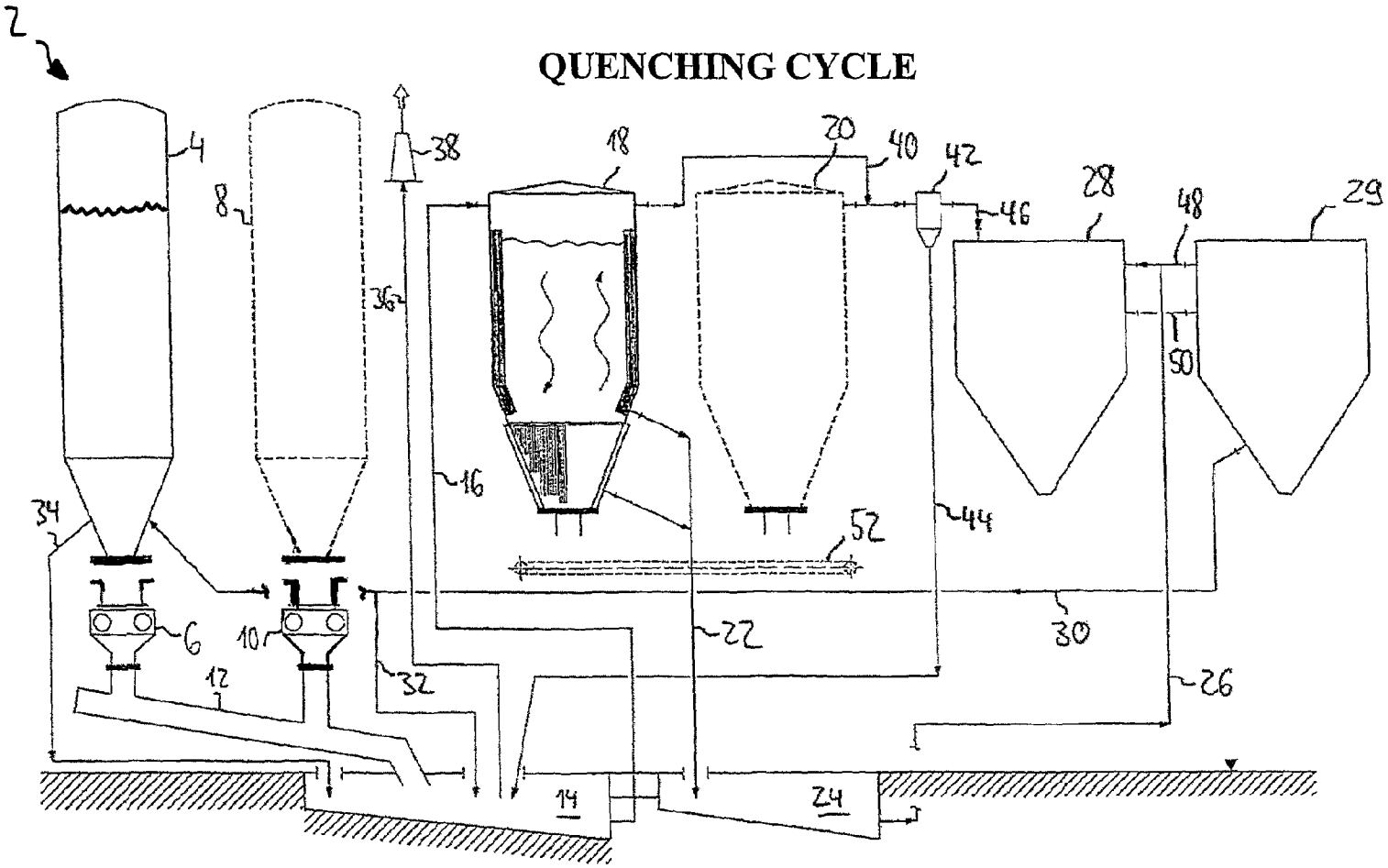
FIG. 1 shows a schematic connection diagram of a closed system for gaining sellable petroleum coke pieces out of solidified petroleum coke in a coke drum unit according to an embodiment of the invention, being operated in a quenching cycle.
Figure 2:
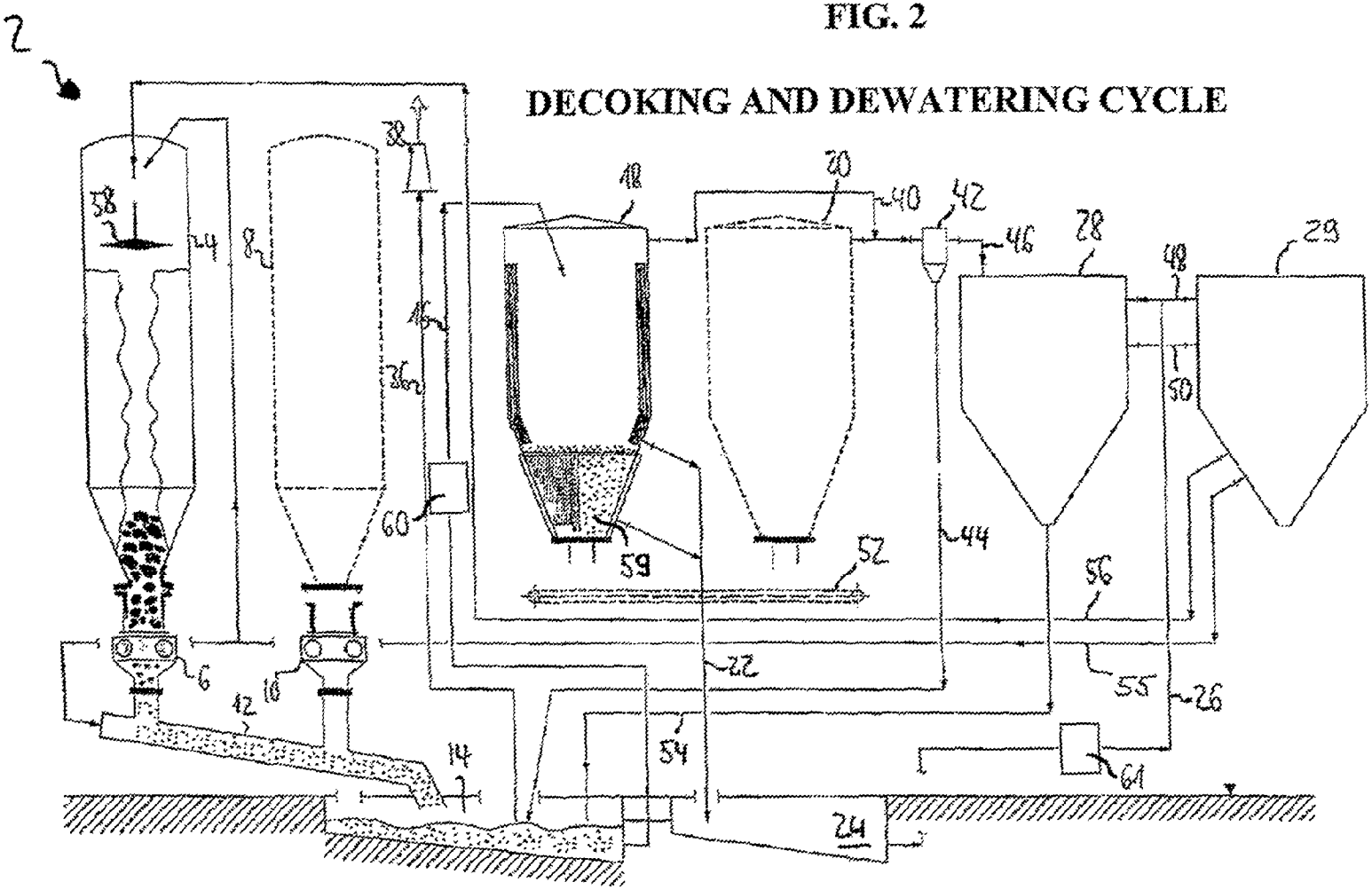
FIG. 2 shows the schematic connection diagram of the system of FIG. 1 according to an embodiment of the invention, being operated in a coke cutting and dewatering cycle.
Figure 3:
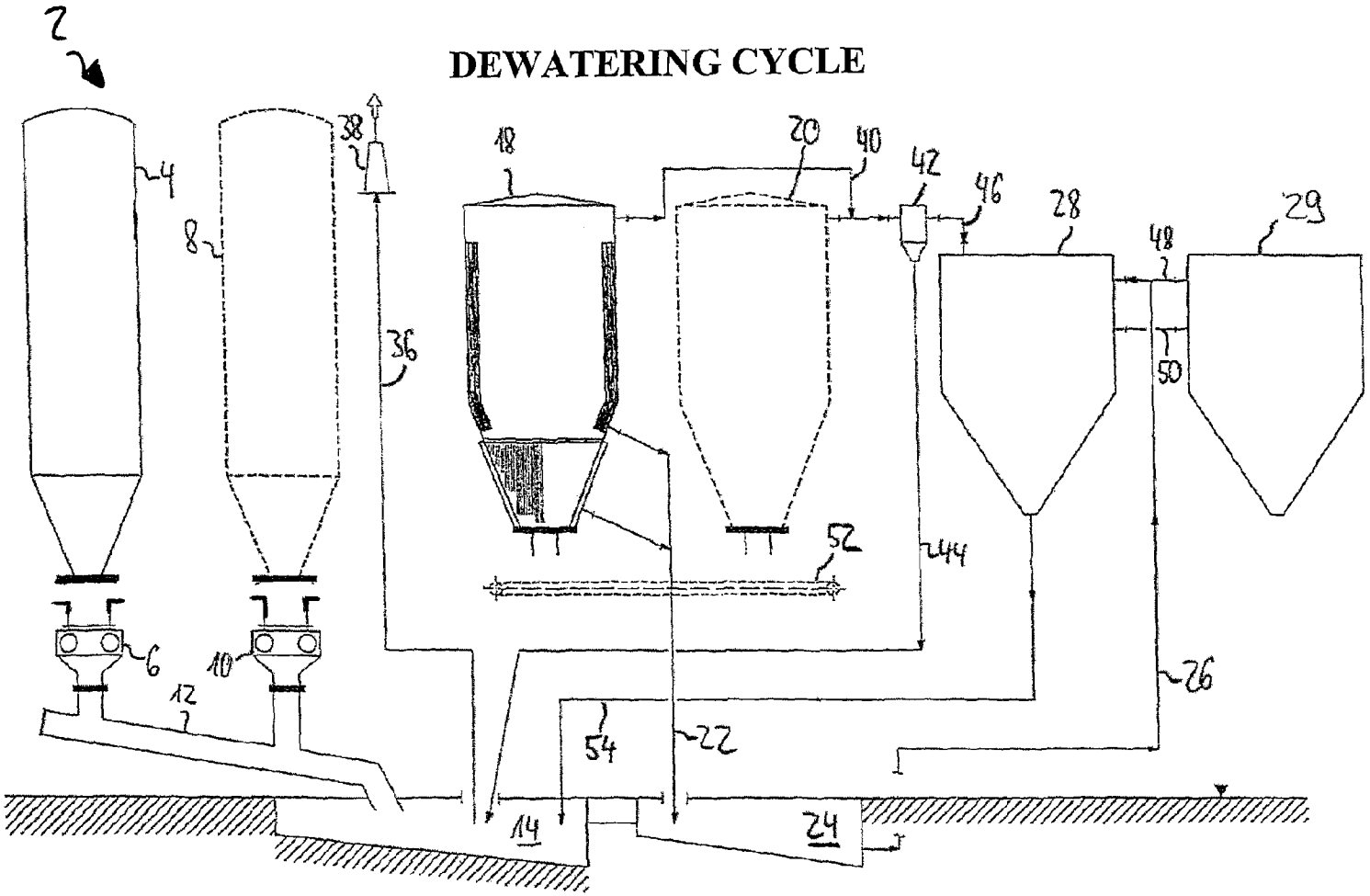
FIG. 3 shows the schematic connection diagram of the system of FIG. 1 according to an embodiment of the invention, being operated in a dewatering cycle.

For the sake of brevity, the system for gaining sellable petroleum coke pieces out of solidified petroleum coke in a coke drum unit that is depicted in FIGS. 1 to 3 is called closed coke slurry system.

FIG. 1 shows a schematic connection diagram of a closed system 2 for gaining sellable petroleum coke pieces out of solidified petroleum coke in a coke drum unit 4, 8 according to an embodiment of the invention, being operated in a quenching cycle.

The system 2 comprises two coke drums 4 and 8 with respective coke crushers 6 and 10 installed underneath and a corresponding number of dewatering bins, namely dewatering bins 18 and 20.

The two coke drums 4 and 8 forming the coke drum unit are shown in the left hand portion of FIG. 1, whereas the dewatering bins 18 and 20 are shown in the middle of FIG. 1. The left coke drum 4 has been filled with petroleum coke that has been solidified in there to form a coke bed and has been decoupled from the furnace coil (not shown), and the left dewatering bin 18 receives the petroleum coke pieces from the coke drum 4, as will be explained afterwards.

The second coke drum 8 and the second dewatering bin 20 are shown in dashed lines which means that they are not used during the drum decoking process of drum 4 but in a later decoking process, when the second coke drum 8 has been filled up with liquid residue to form a coke bed.

Under the coke drums 4 and 8 there are arranged coke crushers 6 and 10 forming the coke crushing unit and they are connectible to the respective coke drums 4 and 8 by telescopic chutes being formed as metal transition pieces, respectively, that can remotely be pulled up. In the quenching cycle operation as shown in FIG. 1, the coke crushers 6 and 10 are not connected to the coke drums 4 and 8, and the bottom of the coke drums 4 and 8 is closed. The telescopic chutes are pulled back with respect to the bottom of the coke drums 4 and 8, and do not connect to the same.

The coke crushers 6 and 10 are mounted below the respective coke drums 4 and 8 such that coke chunks cut out of the coke bed will get through the telescopic chutes into the coke crushers 6 and 10 where they are grinded to sellable coke pieces of a maximum size of 4" (100 mm). Coke pieces of this size can be sold commercially, and they can also be pumped together with the coke-water mixture which will be referred to as slurry afterwards. In order for the coke chunks to get to the coke crushers 6 and 10, the bottom parts of the coke drums 4 and 8 that are depicted by a black horizontally extending line can be opened.

The telescoping chutes can be configured such that they allow for automatic raising and lowering of the chutes and for a secure remote docketing without bolting. In order to avoid that steam is released to the atmosphere, they can be of steam tight construction.

The coke crushers 6 and 10 are of rigid construction and are built of high abrasive-resistant materials. They have a maximum pull-in ability by using larger roll diameters and an optimized teeth pattern. They also have an almost unlimited swallow ability for peak cutting loads, separate direct roll drives with high torque. They are reversible and allow for a fully automated, self-controlling operation.

The outlet lines of the coke crushers 6 and 10 both connect to a slurry pipe 12 that is formed as a closed, oblique pipe, and is made from corrosion and abrasive resistant material. The sellable coke pieces get—by gravity—through the slurry pipe 12 to a slurry pit 14 which is formed as a tight concrete pump pit. From the slurry pit 14, particularly from a bottom portion thereof there extends a slurry line 16 to the upper portion of the dewatering bin 18, through which coke slurry from the slurry pit gets to the dewatering bin 18.

The dewatering bin 18 comprises an upper cylindrical section and a lower conical section. The upper cylindrical section and the upper part of the lower conical section are provided at their inner circumferential portions with filter elements 59 that are formed as screens/sieves, particularly as vertical inner bar screens/sieves in this embodiment, and the lower part of the lower conical section is provided with a filter element which is formed as a perforation pattern in this embodiment. These filter elements are designed to keep the sellable coke pieces in the dewatering bin 18 and to let water comprising coke particles/coke fines pass through. The filter elements of the dewatering bins are connected by means of a drain water line 22 to a drain water pit 24 which is formed separately from the slurry pit 14. In the figures, only the drain water line 22 leading from the filter elements of the first dewatering bin 18 to the drain water pit 24 is shown, a similar drain water line is provided for the second dewatering bin 20.

Both the slurry pit 14 and the drain water pit 24 can be concrete pits and can have a flow optimized design with no stagnant/dead areas.

The bottom portions of the dewatering bins 18 and 20 that are depicted by horizontally extending black lines are opened in order to take the sellable coke pieces out of the dewatering bin at the very end of the delayed coking process. At the very end of the delayed coking process, when the sellable coke pieces are taken out of the dewatering bin they fall through the opened bottom part of the dewatering bin on an appropriate conveyor means which is in the present exemplary embodiment configured as conveyer belt 52 by which the sellable coke pieces are transported to the loading facilities (not shown).

From the drain water pit 24, particularly from its bottom portion, there extends a drain water line 26 which connects to an upper portion of a water settling tank 28. This drain water line 26 can also be connected to a clear water tank 29 by means of a line portion 48 branching off from the drain water line 26.

Additionally, there is arranged a horizontal balancing line 50 between an upper portion of the water settling tank 28 and an upper portion of the clean water tank 29 in order to balance the water levels between those two tanks.

Both the slurry line 16 and the drain water line 26 are provided with appropriate pumps (identified as elements 60 and 61, respectively) such that the petroleum coke slurry comprising sellable coke pieces are pumped from the slurry pit 14 to the dewatering bin 18 and the drain water from the drain water pit 24 are pumped to the water settling tank 28.

The slurry line 16 is of such diameter that the coke slurry comprising sellable coke pieces gets through. Likewise the pump provided in the slurry line is of such configuration that the coke slurry comprising the sellable coke pieces can be pumped. The pump in the slurry line 16 has an impeller design and a casing construction and a material that results in high wear resistance and high tolerance level against cavitation damages.

In the present exemplary embodiment, one line portion of the drain water line 20 connects to the lower end of the vertical screen filtering element and another line portion attaches to the lower end of the perforation filter element, and both line portions connect to a common drain water line 22. By such filter elements the coke slurry comprising the sellable coke pieces within the dewatering bin 18 can be dewatered effectively. No other fixed or floating devices have to be provided. Generally, no backflush nozzles are needed.

Both the water settling tank 28 and the clean water tank 29 are depicted schematically with a cylindrical upper section and a conical lower section. The lines connecting to the conical lower section in order to remove coke fines from the water settling tank 28 and to remove water from the clean water tank 29 are not shown in FIG. 1.

The dewatering bins 18 and 20 are provided with an overflow protection unit/overflow screen that has no active function in normal operation but serves as a safety valve to protect the dewatering bins 18 and 20 from overfilling inadvertently. The overflow screen in the present embodiment is formed as a overflow line 40 attaching at the uppermost portion of the dewatering bins 18 and 20 and a safety valve 42 through which the coke slurry from the dewatering bin is led firstly by means of overflow line 44 to the slurry pit 14 and secondly, if necessary in addition, via overflow line 46 to the water settling tank 28.

For the quenching operation/quenching cycle that is carried out during the delayed decoking process, a cold quench water line 30, a cooling water line 32 and a hot quench water line 34 are provided. The cold quench water line 30 attaches to a lower portion or a bottom portion of the clean water tank 29 and leads to the respective dewatering bin. In FIG. 1 the cold quench water line 30 is shown to lead to the first coke drum 4, a similar cold quench water line 30 can also extend from the clean water tank 29 to the second coke drum 8. By means of the cold quench water line 30 the hot coke bed within the coke drum 4 is cooled down. From the coke drum 4, and likewise from the coke drum 8 (which is not shown) the hot quench water line 34 extends to the slurry pit 14, this hot quench water line 34 leading the quench water that has been warmed up in heat exchange against the coke bed gets into the slurry pit 14. In order to avoid or limit the steam generation within the slurry pit 14, a slurry pit cooling water line 32 branches off from the cold quench water line 30, and cold water coming from the clean water tank 29 is led directly to the slurry pit 14. The cooled mixed quenchwater from the slurry pit 14 is pumped via line 16 in the dewatering bin 18. From the dewatering bin 18—acting as filter—the drainwater runoff flows with line 22 to the clean water pit 24 and is pumped from there via line 26 to the water settling tank 28.

There is a vapor/steam discharging line 36 attaching to the closed slurry pit 14 for routing of remaining vapor to the atmosphere through a vent 38. This vent 38 is preferably positioned above a working platform/above operator level in order to minimize the exposure of operating and maintenance personnel to vapor.

Likewise, steam/vapor discharging lines and vents are provided at the dewatering bins 18 and 20 (not shown) and at the drain water pit 24 (not shown).

FIG. 2 shows the schematic connection diagram of the system 2 according to an embodiment of the invention, being operated in a second coke cutting and dewatering cycle.

In FIG. 2 the quench water lines 30 and 34 and the cooling lines are omitted for simplicity. In addition to FIG. 1 there is shown a line 54 leading from the bottom of the water settling tank 28 to the slurry pit 14, a transport water line 55 leading from the bottom of the clean water tank 29 to the upper portion of the coke drum 4 (a similar line can also lead to the upper portion of the coke drum 8) and to the end portion of the slurry pipe 12 being located upstream of the flow of sellable coke pieces through the slurry pipe 12.

Furthermore there is provided an additional transport water line 56 extending from a lower portion of the water settling tank 28 to the top portion of the coke drum 4. Moreover, there is a schematically depicted a coke cutting unit 58 which is configured to be lowered via the upper coke drum head into the coke drum 4 to ream out the coke drum with high pressure water jets. This coke cutting unit 58 can be a specialized tool configured to drill a vertical channel into the coke bed first, followed by a cutting operation whereby a horizontal jet stream cut slices of coke out of the coke bed which are then flushed down to the telescopic chute onto the coke crusher 6, 10.

The coke bed within the coke drum 4 is schematically depicted in FIG. 2 during ream out operation with such vertical channel and some coke chunks at the bottom. Likewise, the coke pieces flowing through the slurry pipe 12 that have been grinded by the coke crusher 6 to a sellable size, the coke slurry within the slurry pit 14 comprising a mixture of sellable coke pieces, smaller coke particles and water, and the sellable coke pieces collecting in the dewatering bin 18 from bottom to top are also depicted schematically in FIG. 2.

In the coke cutting and dewatering cycle operation as shown in FIG. 2, the coke crusher 6 is connected to the coke drum 4, and the bottom of the coke drum 4 is opened. The telescopic chute of the coke crusher 6 connects to the bottom of the coke drum 4. The coke crusher 10 remains disconnected from the coke drums 4 and 8, with the bottom of the coke drum 8 being closed and the telescopic chute of the coke crusher 10 being pulled back with respect to the bottom of the coke drum 8, until the coke drum 8 will be operated in the coke cutting and dewatering cycle.

FIG. 3 shows the schematic connection diagram of the system 2 according to an embodiment of the invention, being operated in a dewatering cycle.

FIG. 3 corresponds to FIG. 2 wherein the solidified coke from the coke drum 4 has been removed and wherein dewatering of the dewatering bin 18 takes place. In FIG. 3 the quench lines 30, 34 and the cooling water line 32 from the quenching operation depicted in FIG. 1 and the transport water lines 55 and 56 needed for the drum decoking cycle are omitted for simplicity.

In the dewatering cycle operation as shown in FIG. 3, the coke crushers 6 and 10 are again not connected to the coke drums 4 and 8, and the bottom of the coke drums 4 and 8 is closed. The telescopic chutes are pulled back with respect to the bottom of the coke drums 4 and 8, and do not connect to the same. The coke drum 4 or 8 can be filled with petroleum coke again.

For gaining sellable petroleum coke pieces out of solidified petroleum coke in the coke bed of the coke drum 4 the following steps are carried out.

At first the delayed coke system 2 is operated in a quenching cycle which is shown with respect to FIG. 1. In the quenching cycle the coke drum unit 4 is flooded with cold water through the cold quench water line 30 leading from the clean water tank 29 to the coke drum unit 4, where the quench water heats against the solidified coke, which in turn is cooled down, hardens, and then the hot water is led through the hot quench water line 34 to the slurry pit 14. In order to avoid or to limit steam generation within the slurry pit 14, cooling water from the clean water tank 29 is led into the slurry pit 14 via the cooling line 32 branching off the cold quench water line 30. The minimum vapor/steam that generates in the slurry pit is be released to the atmosphere by a vapor discharging line 36 and a vent 38, being positioned preferably above operator level.

Prior to the quenching cycle, additionally steam is introduced into the coke drum 4, which however is not shown in FIG. 1. By introducing steam into the coke drum 4, hydrocarbons can be released from the coke bed and the coke bed is hardened by such steam. The quenching water introduced into the coke drum 4 during the quenching cycle cools down the coke bed in order to lower the temperature under the under the ignition point to avoid self-ignition when opening the coke drum.

After the quenching cycle, the upper and lower coke drum heads are opened. The telescopic chute will be lifted up and attached to lower coke drum flange.

Then, the delayed coke system 2 is operated in a drum decoking and dewatering cycle as second step which is shown with respect to FIG. 2.

In the drum decoking and dewatering cycle, the solidified petroleum coke is cut out of the coke drum 4 by means of the coke cutting unit 58 as described above and as depicted in FIG. 2, so that petroleum coke chunks fall through the telescopic chute onto the crusher 6 which can also be seen in FIG. 2. This cutting operation is supported by transport water flowing through the transport water lines 55 and 56 so that the petroleum coke chunks are flushed down to the crusher 6.

The coke chunks are then crushed into sellable petroleum coke pieces by the coke crusher 6. After the crusher 6, the sellable petroleum coke pieces get into the closed slurry pipe 12 and are led by gravity and with the aid of transport water coming from the clean water tank 29 and flowing through a transport water line 55, that can either come directly from the clean water tank 29 or can branch off the transport water line 55, as shown in FIG. 2, that joins to the outer end of the closed slurry pipe 12 to the slurry pit 14. In the closed slurry pipe 12 and the closed slurry pit 14 there is formed a petroleum coke slurry comprising water, sellable coke pieces and coke particles/coke fines. The petroleum coke slurry is pumped from the slurry pit 14 through the slurry line 16 by means of an appropriate pump provided in this line 16 (not shown) to the dewatering bin 18. There the sellable petroleum coke pieces collect, whereas filtered water and petroleum coke fines get through the filter elements of the dewatering bin 18, as described above. Those petroleum coke pieces that have a size or a diameter being bigger than the openings in the filter elements remain in the dewatering bin 18. This is the bigger portion than the petroleum coke pieces that have a size or a diameter being smaller than the openings in the filter elements and passing through the same. Thereby the amount of sludge in the water settling tank 28 is minimized.

The filtered water and the petroleum coke fines are then led to a drain water pit 24, being separate from the slurry pit 14, through the drain water line 22. The filtered water and the petroleum coke fines are then pumped from the drain water pit 24 to the water settling tank 28 through the drain water line 26. For this purpose there can be provided an appropriate pump (not shown) in said drain water line 26.

In the water settling tank 28, the petroleum coke fines separate from the water and collect in the bottom part thereof, whereas the clean, purified water stays in the upper part of the water settling tank 28, from where it gets to the clean water tank 29 through the horizontal balancing line 50. From the bottom part of the water settling tank 28, the petroleum coke fines together with water are led into the slurry pit 14 through the line 54 connecting the bottom part of the water settling tank 28 to the slurry pit 14. These coke fines mix and therefore well disperse with the coarse sellable coke pieces within the slurry pit to the effect that the coke fines are clamped on the surface of coke pieces or are trapped in the porous lumps of the coke pieces and remain there. From the slurry pit 14, continuously coke slurry comprising sellable coke pieces, coke fines and water is pumped into the dewatering bin 18 through the slurry line 16, and this step and the other steps of the drum decoking and dewatering cycle, as described above, are carried out continuously, until all the petroleum coke from the coke drum 4 has been removed and/or all sellable coke pieces have been pumped into the dewatering bin 18.

Then, the delayed coke system 2 is operated in a dewatering cycle as third step which is shown with respect to FIG. 3.

In the dewatering cycle, the filtered water and petroleum coke fines are led from the dewatering bin unit 18 to the drain water pit 24 through the drain water line 22, the filtered water and the petroleum coke fines are pumped from the drain water pit 24 through the drain water line 26 to the water settling tank 28 where the petroleum coke fines separate from the water and collect in the bottom part thereof, whereas clean, purified water stays in the upper part of the water settling tank 28. Again, clean, purified water from the upper part of the water settling tank 28 gets to the clean water tank 29 through the horizontal balancing line 50. The petroleum coke fines are led from the water settling tank 28 into the slurry pit 14, until a predetermined dewatering level within the dewatering bin unit 18 is reached, which can be measured and detected by an appropriate sensor unit 8 (not shown).

Finally, a fourth removing step is carried out, in which the sellable petroleum coke pieces are taken out of the dewatering bin unit 18 through the bottom part of the dewatering bin 18, which can be opened for this purpose. From there they fall on the conveyer belt 52, by which they are transported to appropriate loading facilities.

During the drum decoking and dewatering cycle which is shown in FIG. 2 and/or the dewatering cycle which is shown in FIG. 3, vapors from the slurry pit 14 and/or the drain water pit 24 and/or the dewatering bin 18 can be discharged via appropriate lines and vents to the atmosphere, preferably above operator level. While the line 36 and the vent 38 for the slurry pit 14 are shown, corresponding lines and vents for the drain water pit 24 and/or the dewatering bin 18, that can be provided, are not shown in the Figures.

For the system and method for gaining sellable petroleum coke pieces out of solidified petroleum coke in a coke drum unit, that have been described by means of the embodiment with respect to the Figures, all technical effects, advantages and specific embodiments that have been described in detail above apply, and they are not repeated to avoid redundancy.

LIST OF REFERENCE NUMERALS

2 petroleum coke handling system
4 first coke drum
6 first crusher
8 second coke drum
10 second crusher
12 slurry pipe
14 slurry pit
16 slurry line
18 first dewatering bin
20 second dewatering bin
22 drain water line
24 drain water pit
26 drain water line
28 water settling tank
29 clean water tank
30 cold quench water line
32 cooling water line
34 hot quench water line
36 vapor discharging line
38 vent
40 overflow line
42 safety valve
44 overflow line to slurry pit
46 overflow line to water settling tank
48 line to clean water tank
50 balancing line
52 conveyer belt
54 line to slurry pit
55 transport water line
56 transport water line
58 coke cutting unit

I claim:

1. A method for gaining sellable petroleum coke pieces out of solidified petroleum coke in a coke drum unit using a closed system, comprising the steps of:

performing a quenching cycle in which the coke drum unit is flooded by means of a quench water line leading from a clean water tank via the coke drum unit to a slurry pit, thereby cooling the solidified petroleum coke;

performing a drum decoking and dewatering cycle in which petroleum coke chunks coming from the coke drum unit are crushed into sellable petroleum coke pieces by means of a coke crushing unit, the sellable petroleum coke pieces being propelled with the aid of transport water which together form a petroleum coke slurry which is then moved to a closed slurry pit through a closed slurry pipe, the petroleum coke slurry then being pumped from the slurry pit to the dewatering bin unit, the sellable petroleum coke pieces then being collected in the dewatering bin unit and the petroleum coke fines separated from the water and collected in a bottom part of a water settling tank;

performing a dewatering cycle;

performing a removing step, in which the sellable petroleum coke pieces are taken out of the dewatering bin unit, including the steps of in the drum decoking and dewatering cycle, filtering the coke slurry using the dewatering bin unit and transporting the runoff drain water from a lower area of the dewatering bin unit as a combination of filtered water and petroleum coke fines to a drain water pit that is separate from the slurry pit, and pumping the filtered water and the petroleum coke fines from the drain water pit to a water settling tank, where after the petroleum coke fines are led into the slurry pit where they mix with the petroleum coke slurry;

wherein in the step of performing a dewatering cycle, filtered water and petroleum coke fines are led from the dewatering bin unit to the drain water pit, the filtered water and the petroleum coke fines are pumped from the drain water pit to the water settling tank where the petroleum coke fines separate from the water and collect in the bottom part thereof, and the petroleum coke fines are led into the slurry pit, until a predetermined dewatering level within the dewatering bin unit is reached.

2. The method according to claim 1, wherein, in the drum decoking and dewatering cycle and/or the dewatering cycle, the purified water from the water settling tank is led to a clean water tank.

3. The method according to claim 1, wherein during the drum decoking and dewatering cycle and the dewatering cycle vapors from the slurry pit and the drain water pit are discharged via vents to the atmosphere above operator level.

4. The method according to claim 1, wherein, in the drum decoking and dewatering cycle solidified petroleum coke is cut out of the coke drum unit by means of a coke cutting unit.

5. A closed system for gaining sellable petroleum coke pieces out of solidified petroleum coke in a coke drum unit, comprising a coke drum unit for containing the solidified petroleum coke;

a coke crushing unit for crushing petroleum coke into sellable petroleum coke pieces;

a closed slurry pipe leading petroleum coke slurry to a closed slurry pit;

a dewatering bin unit with dewatering bins configured to receive the petroleum coke slurry from the slurry pit in order to collect the sellable petroleum coke pieces, a water settling tank;

a clean water tank configured to receive purified water from an upper part of the water settling tank; and a removal unit configured to remove the sellable petroleum coke pieces from the dewatering bin unit;

wherein the dewatering bins provide runoff drain water from a lower area of the dewatering bins as filtered water and the dewatering bins output the filtered water together with petroleum coke fines;

a closed drain water pit, separate from the slurry pit, configured to receive the filtered water and the petroleum coke fines from the dewatering bin unit via a line connecting the dewatering bin unit to the drain water pit; and wherein the water settling tank is configured to receive the filtered water and the petroleum coke fines from the drain water pit and separate the petroleum coke fines from the water by collecting the petroleum coke fines in the bottom part of the water settling tank, and lead the petroleum coke fines into the slurry pit where they mix with the petroleum coke slurry;

wherein the dewatering bins include an upper cylindrical section and a lower conical section, the upper cylindrical section and the upper part of the lower conical section being provided with filtering channels including inner screens, and/or the lower part of the lower conical section being provided with a perforation pattern for removing accumulated water from the dewatering bins; and wherein piping connects the filtering channels and/or the perforation pattern to the line leading to the drain water pit.

6. The system according to claim 5, wherein a quench water line is provided leading from the clean water tank via the coke drum unit to the slurry pit, for flooding the coke drum unit, thereby hardening and cooling the solidified petroleum coke.

7. The system according to claim 5, wherein a slurry pit cooling line is provided connecting the clean water tank to the slurry pit, for cooling the slurry pit.

8. The system according to claim 5, wherein a line is provided connecting the slurry pit to the dewatering bin unit, the line being configured for the pumping of petroleum coke slurry to the dewatering bin unit.

9. The system according to claim 5, wherein a line is provided connecting the drain water pit to the water settling tank, the line being configured for the pumping of the filtered water and the petroleum coke fines to the water settling tank.

10. The system according to claim 5, further comprising a coke cutting unit for cutting the solidified petroleum coke out of the coke drum unit.

11. The system according to claim 10, wherein a water drilling/cutting tool is operated with water from the clean water tank.

12. The system according to claim 5, wherein the coke crushing unit is formed as a respective coke crusher mounted under a respective coke drum of the coke drum unit.

13. The system according to claim 12, wherein for each pair of coke drum and coke crusher a metal transition piece, including a telescopic chute with remote hydraulic devices, is provided to connect the respective coke crusher to the respective coke drum.

14. The system according to claim 5, wherein the coke crushing unit is configured to grind coke chunks that are cut from the solidified petroleum coke by a coke cutting unit into petroleum coke pieces of a size suitable for pumping with the petroleum coke slurry.

15. The system according to claim 5, wherein a transport water line is provided leading from the clean water tank to the closed slurry pipe for supporting flushing and pumping of the petroleum coke slurry to the slurry pit.

16. The system according to claim 5, wherein the line leading from the slurry pit to the dewatering bin unit is provided with a corrosion and erosion resistant pump for pumping the petroleum coke slurry to the dewatering bin unit.

17. The system according to claim 5, wherein the line leading from the drain water pit to the water settling tank is provided with a cavitation, corrosion and erosion resistant pump for pumping the water together with the petroleum coke fines to the water settling tank.

18. The system according to claim 5, wherein the water settling tank and the clean water tank are connected to one another by a balancing line arranged at an upper portion thereof.

19. The system according to claim 5, wherein the removal unit is formed as a conveyer belt positioned below the dewatering bin unit so as to transport the sellable petroleum coke pieces falling out from the dewatering bin unit once the bottom part thereof is opened, to appropriate loading facilities.

20. The system according to claim 5, wherein the slurry pit and/or the drain water pit and/or the dewatering bins are provided with vents for discharging vapors to the atmosphere, with the outlets of the vents being situated above operator level.

21. The system according to claim 5, wherein the dewatering bin unit is provided with an overflow protection unit, the overflow protection unit being configured as a line attaching at an upper portion of the dewatering bin unit and leading to the slurry pit and/or the water settling tank.

22. The system according to claim 5, wherein the number of coke drum units corresponds to the number of dewatering bins, and wherein one pair of coke drum and dewatering bin can be connected at a time to the slurry pit and water settling tank.

* * * * *